US011668477B2

(12) United States Patent
Reynolds et al.

(10) Patent No.: US 11,668,477 B2
(45) Date of Patent: Jun. 6, 2023

(54) SYSTEM AND METHOD FOR VENTILATING AND DEHUMIDIFYING A SPACE

(71) Applicant: Kentuckiana Curb Company, Inc., Louisville, KY (US)

(72) Inventors: Jordan Scott Reynolds, Louisville, KY (US); William Dale Keen, Norwood, KY (US)

(73) Assignee: KENTUCKIANA CURB COMPANY, INC., Louisville, KY (US)

( * ) Notice: Subject to any disclaimer, the term of this patent is extended or adjusted under 35 U.S.C. 154(b) by 262 days.

(21) Appl. No.: 17/214,099

(22) Filed: Mar. 26, 2021

(65) Prior Publication Data

US 2022/0221164 A1 Jul. 14, 2022

Related U.S. Application Data

(60) Provisional application No. 63/135,194, filed on Jan. 8, 2021.

(51) Int. Cl.
*F24F 3/14* (2006.01)
*F24F 11/86* (2018.01)
(Continued)

(52) U.S. Cl.
CPC ..... *F24F 3/1405* (2013.01); *F24F 3/153* (2013.01); *F24F 11/86* (2018.01); *F24F 2140/12* (2018.01)

(58) Field of Classification Search
CPC ..... F24F 3/1405; F24F 3/153; F24F 11/86; F24F 2140/12
See application file for complete search history.

(56) References Cited

U.S. PATENT DOCUMENTS 4,912,933 A * 4/1990 Renken ..... F25D 29/003 62/81
5,309,725 A * 5/1994 Cayce ..... F24F 3/153 62/90

(Continued)

FOREIGN PATENT DOCUMENTS

CN 110779248 A * 2/2020
JP 08121888 A * 5/1996

OTHER PUBLICATIONS

Trane, Impact of DOAS Supply-Air Dew Point Temperature on Space Humidity, Mar. 2020, Trane Engineers Newsletter vol. 49-1 (Year: 2020).*

(Continued)

*Primary Examiner* — Devon Russell
(74) *Attorney, Agent, or Firm* — Neo IP

(57) ABSTRACT

A dedicated outdoor air system (DOAS) includes an outdoor unit providing a temperature at a set dry bulb temperature and dew point temperature in a wide variety of outdoor air conditions. The DOAS monitors and modulates suction pressure and head pressure in order to maintain a dew point temperature of 45° F. for supplied air. Furthermore, the DOAS includes a hot gas reheat coil, allowing the system to heat the air to 73° F. before supplying the air to a space, even where outdoor air temperature is lower than 73° F. In one embodiment, the DOAS includes an energy recovery ventilator (ERV) in order to precondition the air to decrease the amount of energy needed to operate the DOAS in some conditions.

19 Claims, 8 Drawing Sheets

(51) Int. Cl.
*F24F 3/153* (2006.01)
*F24F 140/12* (2018.01)

(56) References Cited

U.S. PATENT DOCUMENTS

| | | | | |
|---|---|---|---|---|
| 6,792,767 | B1 * | 9/2004 | Pargeter | F24F 3/153 62/173 |
| 9,809,088 | B2 * | 11/2017 | Hovel | B60H 1/00828 |
| 10,060,638 | B2 | 8/2018 | Fischer et al. | |
| 10,072,863 | B2 | 9/2018 | Wallace | |
| 10,557,643 | B2 * | 2/2020 | Nelson | F24F 13/10 |
| 10,690,358 | B2 | 6/2020 | Fischer | |
| 2018/0142909 | A1 | 5/2018 | Kraft et al. | |
| 2018/0252487 | A1 | 9/2018 | Wintemute et al. | |
| 2019/0154281 | A1 | 5/2019 | Rosenblum et al. | |
| 2019/0176084 | A1 | 6/2019 | Claridge et al. | |
| 2019/0277515 | A1 | 9/2019 | Duncan | |
| 2020/0124299 | A1 | 4/2020 | Sugitani et al. | |
| 2020/0348040 | A1 | 11/2020 | Furman et al. | |

OTHER PUBLICATIONS

Michael D. Larrañaga, Ph.D., P.E et al., DOAS & Humidity Control, May 2008, ASHRAE Journal, pp. 34-40 (Year: 2008).*
Impact of DOAS Supply-Air Dew Point Temperature on Space Humidity, Trane Engineers Newsletter, Mar. 2020, vol. 49-1.

* cited by examiner

| Point | CFM | Amb. DB (°F) | OA DB (°F) | OA WB (°F) | ERV DB (°F) | ERV WB (°F) | Total Cap. (Btu/hr.) | Sens. Cap. (Btu/hr.) | Evap. DB (°F) | Evap. WB (°F) | Evap. DP (°F) | MRC (lbs H20/hr.) | MRE (lbs H20/kWh) | HGRH LAT (°F) | HGRH Cap. (Btu/hr.) | Supp. Heat (Btu/hr.)* |
|---|---|---|---|---|---|---|---|---|---|---|---|---|---|---|---|---|
| Design | 5000 | 96.0 | 84.4 | 80.2 | 77.0 | 70.2 | 580,107 | 216,252 | 45.3 | 45.0 | 44.8 | 341.8 | 10.62 | 73.4 | 145,651 | 0 |
| 920A | 5000 | 95.0 | 95.0 | 76.0 | 80.8 | 68.6 | 538,354 | 269,325 | 46.0 | 45.5 | 45.0 | 236.5 | 7.28 | 73.4 | 141,232 | 0 |
| 920B | 5000 | 80.0 | 80.0 | 73.0 | 76.5 | 66.8 | 434,789 | 190,961 | 45.4 | 45.3 | 45.2 | 215.1 | 8.97 | 72.5 | 140,229 | 0 |
| 920C | 5000 | 70.0 | 70.0 | 68.0 | 73.5 | 64.2 | 291,228 | 134,576 | 45.6 | 45.4 | 45.2 | 145.4 | 7.21 | 73.1 | 141,780 | 0 |
| 920D | 5000 | 63.0 | 63.0 | 59.0 | 63.0 | 59.0 | 181,565 | 98,317 | 45.1 | 45.1 | 45.1 | 78.2 | 4.96 | 71.9 | 137,825 | 0 |
| PLD1 | 5000 | 75.0 | 75.0 | 73.0 | 75.0 | 67.0 | 433,862 | 161,943 | 45.7 | 45.4 | 45.2 | 241.4 | 9.88 | 73.5 | 143,668 | 0 |
| PLD2 | 5000 | 72.0 | 72.0 | 70.0 | 74.1 | 65.8 | 368,056 | 146,233 | 45.6 | 45.3 | 45.1 | 203.1 | 9.13 | 72.6 | 139,687 | 0 |
| PLD3 | 5000 | 65.0 | 65.0 | 64.0 | 72.1 | 63.5 | 258,486 | 108,521 | 45.4 | 45.3 | 45.3 | 138.6 | 8.73 | 73.5 | 145,035 | 0 |
| PLD4 | 5000 | 60.0 | 60.0 | 58.0 | 60.0 | 58.0 | 151,168 | 67,067 | 47.8 | 46.4 | 45.2 | 79.1 | 5.63 | 73.3 | 131,182 | 0 |
| PLD5 | 5000 | 55.0 | 55.0 | 54.0 | 55.0 | 54.0 | 105,037 | 48,535 | 46.2 | 45.6 | 45.0 | 53.2 | 3.46 | 73.5 | 141,065 | 0 |
| User1 | 5000 | 60.0 | 60.0 | 56.0 | 60.0 | 56.0 | 135,121 | 80,936 | 45.3 | 45.3 | 45.3 | 50.9 | 3.74 | 73.4 | 145,429 | 0 |
| User2 | 5000 | 70.0 | 70.0 | 64.0 | 73.5 | 63.4 | 258,400 | 135,145 | 45.5 | 45.3 | 45.1 | 114.7 | 5.97 | 72.2 | 137,847 | 0 |
| User3 | 5000 | 65.0 | 65.0 | 62.0 | 65.0 | 62.0 | 229,024 | 109,998 | 45.1 | 45.0 | 45.0 | 111.7 | 5.80 | 73.5 | 147,167 | 0 |

FIG. 3

SYSTEM AND METHOD FOR VENTILATING AND DEHUMIDIFYING A SPACE

CROSS REFERENCE TO OTHER APPLICATIONS

This application is related to and claims priority from the following U.S. patents and patent applications. This application claims priority from U.S. Provisional Application No. 63/135,194, filed Jan. 8, 2021, which is incorporated herein by reference in its entirety.

BACKGROUND OF THE INVENTION

1. Field of the Invention

The present invention relates to systems and method for heating, cooling, and dehumidifying a space, and more specifically to the use of dedicated outdoor air systems (DOAS) in order to heat, cool, and dehumidify buildings.

2. Description of the Prior Art

It is generally known in the prior art to provide dedicated outdoor air systems, capable of heating and cooling a building.

Prior art patent documents include the following:

U.S. Pat. No. 10,557,643 for Demand ventilation HVAC system comprising independently variable refrigerant flow (VRF) and variable air flow (VAF) by inventor Nelson, filed Jan. 14, 2017 and issued Feb. 11, 2020, is directed to a dedicated outside air system comprising a combined variable refrigerant flow and variable air flow that provides ventilation in an energy efficient way or otherwise as desired.

U.S. Pat. No. 10,690,358 for Air conditioning with recovery wheel, passive dehumidification wheel, cooling coil, and secondary direct expansion circuit by inventor Fischer, filed Jun. 7, 2017 and issued Jun. 23, 2020, is directed to air conditioning units, systems, and methods that control temperature and humidity within a space in a building, for example, using a recovery wheel, a desiccant-based or passive dehumidification wheel, a primary cooling coil; and a secondary direct-expansion refrigeration circuit that includes a secondary circuit compressor, a secondary circuit evaporator coil, and a secondary circuit condenser coil. In various embodiments, the system forms a supply airstream that passes outdoor air first through the recovery wheel, then through the primary cooling coil, then through the secondary circuit evaporator coil, then through the dehumidification wheel, and then to the space. Further, in many embodiments, the system forms an exhaust airstream that passes return air from the space first through the secondary circuit condenser coil, then through the dehumidification wheel, and then through the recovery wheel. In some embodiments, various quantities of heat and moisture are transferred between the two airstreams.

U.S. Pat. No. 10,060,638 for Chilled beam pump module, system, and method by inventors Fischer et al., filed Mar. 8, 2017 and issued Aug. 28, 2018, is directed to multiple-zone chilled beam air conditioning systems for cooling multiple-zone spaces, methods of controlling chilled beams in multi-zone air conditioning systems, and chilled-beam pump modules for controlling zones of a chilled-beam heating and air conditioning system. Embodiments include a pump serving each zone that both recirculates water within the module and chilled beam and circulates water in and out of a chilled water distribution system through one or more valves to control the temperature of the water delivered to the chilled beams. Different embodiments adjust the temperature of the beam to avoid condensation, change pump speed to save energy or increase capacity, provide heating as well as cooling, use check valves to reduce the number of control valves required, can be used in two- or four-pipe systems, or a combination thereof.

US Patent Publication No. 2019/0277515 for Energy Recovery High Efficiency Dehumidification System by inventor Duncan, filed Dec. 27, 2018 and published Sep. 12, 2019, is directed to systems and methods for providing hot air or hot dehumidified air to a facility using an energy recovery high efficiency dehumidification system. The energy recovery high efficiency dehumidification system can include an air filter bank that receives air from a first inlet source, a supply fan that causes the air to flow from the first inlet source, a cooling coil configured to cool and reduce a relative humidity of the air that passes over the cooling coil, a cooling recovery coil coupled with the cooling coil and configured to heat the cooled air to generate cooled dehumidified reheated air in a cooling recovery coil plenum, an equipment room configured to surround mechanical and electrical equipment and further heat received cooled dehumidified reheated air, and a heat rejection coil that rejects heat from one or more components of the mechanical and electrical equipment to further heat the air.

US Patent Publication No. 2018/0252487 for System and method for conditioning air in an enclosed structure by inventors Wintemute et al., filed Apr. 30, 2018 and published Sep. 6, 2018, is directed to an energy exchange system includes a supply flow path including a central sub-path connected to a bypass sub-path that is, in turn, connected to a delivery sub-path that connects to the enclosed structure. A sensible heat exchanger configured to condition the supply air is disposed within the central sub-path. The bypass sub-path connects to the central sub-path upstream from the sensible heat exchanger within the central sub-path. A first coil configured to further condition the supply air is disposed within the central sub-path downstream from the sensible heat exchanger. A bypass damper is disposed within the bypass sub-path. The bypass damper is configured to be selectively opened and closed. The bypass damper allows at least a portion of the supply air to pass through the bypass sub-path into the delivery sub-path and bypass the sensible heat exchanger and the first coil when the bypass damper is open.

US Patent Publication No. 2019/0154281 for Control system for liquid desiccant air conditioning systems by inventors Rosenblum et al., filed Nov. 1, 2018 and published May 23, 2019, is directed to methods and control systems are disclosed for operating a liquid desiccant air-conditioning system to efficiently maintain a target temperature and humidity level in a space.

US Patent Publication No. 2020/0348040 for System and Apparatus for Conditioning of Indoor Air by inventors Furman et al., filed May 1, 2020 and published Nov. 5, 2020, is directed to a control system is provided for controlling heating and/or cooling with a conditioning load such as fan coils and chilled beams. Based on user input and ambient conditions, the control system determines a desired temperature for the liquid entering the load and combines fresh supply liquid (e.g., from a chiller or boiler) with a portion of the liquid that has passed through the load, to achieve the target load input temperature for the liquid. A recirculation pump may be used to return a portion of the liquid exiting the load for mixing with the fresh supply liquid and a control valve may be used to adjust the ratio of fresh supply liquid and recirculated liquid to achieve the targeted temperature. The control systems can be compatible with a variety of liquid supply systems such as two- and four-pipe systems.

US Patent Publication No. 2019/0176084 for Systems and methods for multi-stage air dehumidification and cooling by inventor Claridge, filed Feb. 15, 2019 and published Jun. 13, 2019, is directed to systems and methods for dehumidifying air by establishing a humidity gradient across a water selective permeable membrane in a dehumidification unit. Water vapor from relatively humid atmospheric air entering the dehumidification unit is extracted by the dehumidification unit without substantial condensation into a low pressure water vapor chamber operating at a partial pressure of water vapor lower than the partial pressure of water vapor in the relatively humid atmospheric air. For example, water vapor is extracted through a water permeable membrane of the dehumidification unit into the low pressure water vapor chamber. As such, the air exiting the dehumidification unit is less humid than the air entering the dehumidification unit. The low pressure water vapor extracted from the air is subsequently condensed and removed from the system at ambient conditions.

U.S. Pat. No. 10,072,863 for Hydronic building systems control by inventor Wallace, filed Jul. 5, 2016 and issued Sep. 11, 2018, is directed to controlling heating and cooling in a conditioned space utilizes a fluid circulating in a thermally conductive structure in fluid connection with a hydronic-to-air heat exchanger and a ground heat exchanger. Air is moved past the hydronic-to-air heat exchanger, the air having fresh air supply and stale air exhaust. Sensors located throughout the conditioned space send data to a controller. User input to the controller sets the desired set point temperature and humidity. Based upon the set point temperature and humidity and sensor data, the controller sends signals to various devices to manipulate the flow of the fluid and the air in order to achieve the desired set point temperature and humidity in the conditioned space. The temperature of the fluid is kept less than the dew point at the hydronic-to-air heat exchanger and the temperature of the fluid is kept greater than the dew point at the thermally conductive structure.

US Patent Publication No. 2020/0124299 for Air-conditioning system, air-conditioning method, and environmental test chamber by inventors Sugitani et al., filed Jun. 25, 2018 and published Apr. 23, 2020, is directed to an air-conditioning system includes: a dehumidifying unit configured to mix air discharged from an environmental testing chamber with outside air for dehumidification and to discharge dry air; a dry air thermal controlling unit configured to thermally control the dry air discharged from the dehumidifying unit to have a temperature lower than a preset air temperature inside the environmental testing chamber; and a dry air heating unit configured to heat the dry air thermally controlled by the dry air thermal controlling unit up to the preset air temperature and to supply the dry air to the environmental testing chamber. The dehumidifying unit preferably discharges the dry air having a dew point temperature of −30° C. or less.

US Patent Publication No. 2018/0142909 for Control of Residential HVAC Equipment for Dehumidification by inventors Kraft et al., filed Nov. 17, 2017 and published May 24, 2018, is directed to systems and methods are disclosed that include providing a heating, ventilation, and/or air conditioning (HVAC) system with a system controller and an indoor air handling unit comprising an auxiliary heat source, whereby the system controller is configured to employ a hysteresis control algorithm to operate the HVAC system in a cooling mode while simultaneously operating the auxiliary heat source to provide a dehumidified, temperature-conditioned airflow to a zone conditioned by the HVAC system.

SUMMARY OF THE INVENTION

The present invention relates to systems and method for heating, cooling, and dehumidifying a space.

It is an object of this invention to provide an air conditioning system capable of delivering 45° F. dew point temperature air.

In one embodiment, the present invention is directed to a climate-control system, including a refrigeration circuit including at least one compressor, a condenser, an expansion valve, and an evaporator coil, and a hot gas reheat unit positioned between the at least one compressor and the condenser in the refrigeration circuit, wherein the climate-control system is operable to deliver air to a space at about a 45° F. or lower dew point temperature.

In another embodiment, the present invention is directed to a method of delivering air to a space, including providing a unit, including a refrigeration circuit including at least one compressor, a condenser, an expansion valve, and an evaporator coil, wherein the unit further includes a hot gas reheat unit positioned between the at least one compressor and the condenser in the refrigeration circuit, and the unit delivering air to the space at about a 45° F. or lower dew point temperature.

In yet another embodiment, the present invention is directed to a climate-control system, including a refrigeration circuit including at least one compressor, a condenser, an expansion valve, and an evaporator coil, a hot gas reheat unit positioned between the compressor and the condenser in the refrigeration circuit, and at least one detector monitoring the head pressure of refrigerant exiting the at least one compressor and/or at least one detector monitoring the suction pressure of refrigerant entering the at least one compressor, wherein the at least one compressor is operable to engage in continuous modulation based on data produced by the at least one detector monitoring the head pressure of refrigerant exiting the at least one compressor and/or the at least one detector monitoring the suction pressure of refrigerant entering the at least one compressor.

These and other aspects of the present invention will become apparent to those skilled in the art after a reading of the following description of the preferred embodiment when considered with the drawings, as they support the claimed invention.

BRIEF DESCRIPTION OF THE DRAWINGS

FIG. 3 is a chart detailing the performance of an HVAC system at various load conditions according to one embodiment of the present invention.

DETAILED DESCRIPTION

The present invention is generally directed to systems and method for heating, cooling, and dehumidifying a space.

In one embodiment, the present invention is directed to a climate-control system, including a refrigeration circuit including at least one compressor, a condenser, an expansion valve, and an evaporator coil, and a hot gas reheat unit positioned between the at least one compressor and the condenser in the refrigeration circuit, wherein the climate-control system is operable to deliver air to a space at about a 45° F. or lower dew point temperature.

In another embodiment, the present invention is directed to a method of delivering air to a space, including providing a unit, including a refrigeration circuit including at least one compressor, a condenser, an expansion valve, and an evaporator coil, wherein the unit further includes a hot gas reheat unit positioned between the at least one compressor and the condenser in the refrigeration circuit, and the unit delivering air to the space at about a 45° F. or lower dew point temperature.

In yet another embodiment, the present invention is directed to a climate-control system, including a refrigeration circuit including at least one compressor, a condenser, an expansion valve, and an evaporator coil, a hot gas reheat unit positioned between the at least one compressor and the condenser in the refrigeration circuit, and at least one detector monitoring the head pressure of refrigerant exiting the at least one compressor and/or at least one detector monitoring the suction pressure of refrigerant entering the at least one compressor, wherein the at least one compressor is operable to engage in continuous modulation based on data produced by the at least one detector monitoring the head pressure of refrigerant existing the at least one compressor and/or the at least one detector monitoring the suction pressure of refrigerant entering the at least one compressor.

Figure 1:
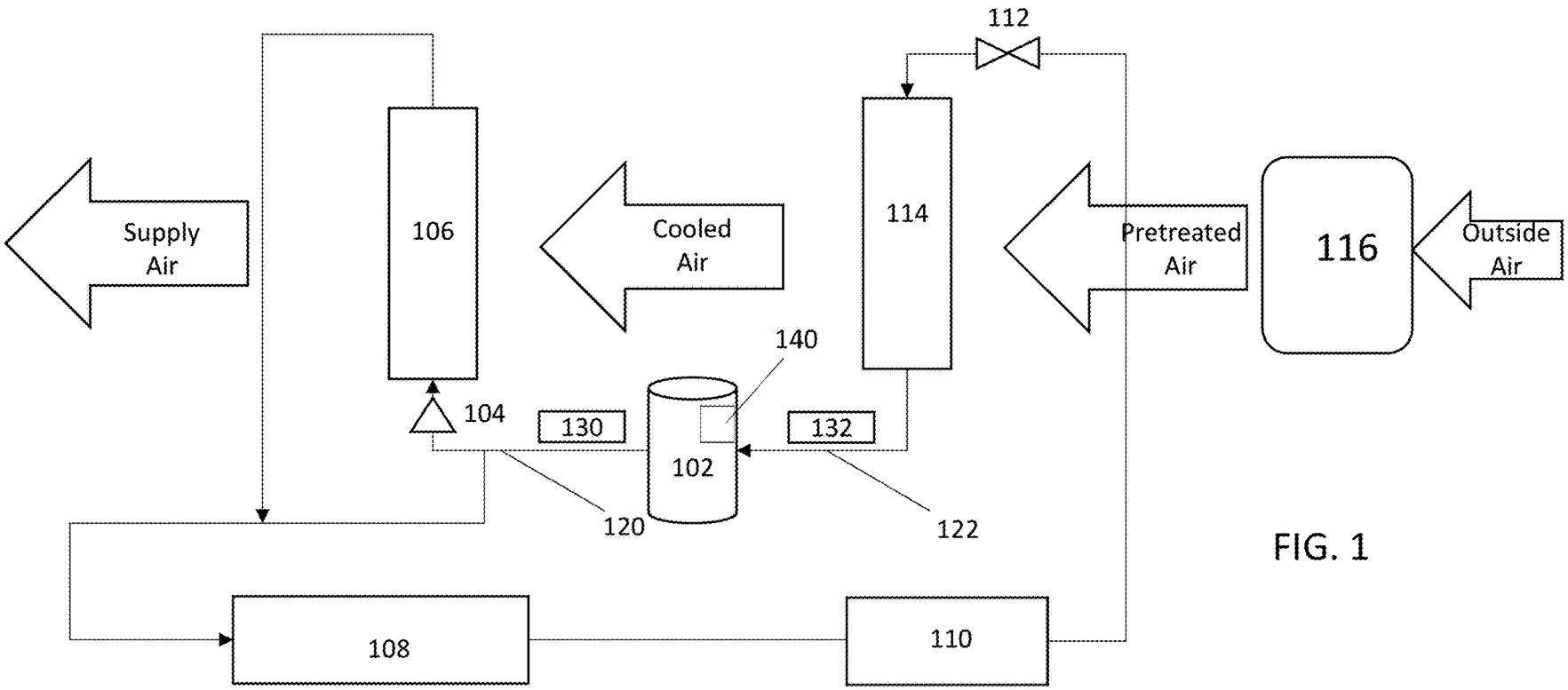
FIG. 1 is a schematic diagram of a heating, ventilation, and air conditioning (HVAC) system according to one embodiment of the present invention.

As shown in FIG. 1, the present invention includes at least one compressor 102, a condenser 108, an expansion valve 112, and an evaporation coil 114, with a line of refrigerant running through each element. In one embodiment, the at least one compressor 102 includes at least three compressors. When the refrigerant enters the at least one compressor 102, pressure is added, causing the temperature of the refrigerant to increase greatly before the refrigerant enters the condenser 108. Incoming air is drawn over the at least one condenser by a fan, causing heat to transfer away from the refrigerant within the condenser 108 and into the air. The condenser 108 takes in the refrigerant in the form of a hot gas and cools it to a liquid before passing it to a receiving tank 110, and before the refrigerant is sent from the receiving tank 110 to the expansion valve 112. The expansion valve 112 regulates the quantity of refrigerant that enters into the evaporation coil 114 in order to maximize the thermal efficiency of the evaporation coil 114. Air passes over the evaporation coil 114 before being released into the space or sent to a separate terminal unit. Because the refrigerant within the evaporation coil 114 is at a lower temperature than the air, heat is transferred from the air into the refrigerant causing the refrigerant to heat and evaporate before the it reenters the compressor 102 through a suction line 122. In addition to cooling the air, the heat transfer in the evaporation coil 114 causes an amount of water vapor to fall out of solution in the air in the form of condensation, thereby dehumidifying the air.

In some situations, the air coming off the evaporation coil 114 is too cold for the desired conditions of the space. Therefore, in one embodiment, the present invention includes a hot gas reheat unit 106 (e.g., a hot gas reheat coil) in connection with the compressor 102, the condenser 108, the expansion valve 112, and the evaporation coil 114. When the hot gas-phase refrigerant exits the compressor 102, it enters the hot gas reheat unit 106 through a liquid line 120. The hot gas reheat unit 106 is positioned between the evaporation coil 114 and a supply fan within the HVAC unit, therefore causing the air to pass over the hot gas reheat unit 106 after passing over the evaporation coil 114. Because the temperature of the refrigerant in the hot gas reheat unit 106 is much higher than the surrounding air, heat is transferred from the refrigerant to the air, causing the air to reheat before entering the space or before entering a separate terminal unit. However, because some of the water vapor fell out of solution when the air passed over the evaporation coil 114, the newly reheated air is less humid than the air that originally passed over the evaporation coil 114.

Traditional compressors only have "on" and "off" positions. When a temperature detection unit within the device detects that the temperature of the space has fallen below (in the case of cooling) or above (in the case of heating) a set temperature, then the compressor is turned off. Thereafter, when the temperature of the space rises above (in the case of cooling) or below (in the case of heating) the set temperature, the compressor turns back on and begins operation. However, on-off compressor systems cause temperature and humidity fluctuations within the space, which often cause discomfort for individuals within the space. Adding a hot gas reheat unit 106 helps reduce the magnitude of the fluctuations within the system, but at part-loads, there is not enough hot gas to continue operation, leading to low pressure in the suction line 122 that causes the compressor 102 to keep cycling. Low suction pressure also causes the temperature of the refrigerant entering the evaporation coil 114 to be lower, often below the freezing point of water (or roughly 32° F.). As water vapor from the air falls out of solution and condenses on the evaporation coil 114, the low temperature of the refrigerant often causes the water vapor to freeze on the evaporation coil 114, leading to the develop of ice that damages the function of the system.

In order to prevent ice buildup, existing systems have developed methods to increase suction pressure. One existing method is to use a hot gas bypass valve. Hot gas bypass methods divert a portion of the gas from the discharge line of the compressor directly into the suction line. By increasing the volume of the refrigerant entering the suction line and increasing the temperature of the refrigerant entering the line, suction pressure is also increased, preventing the buildup of ice on the evaporation coil. However, in systems using a hot gas reheat unit, existing hot gas bypass systems detract from the pressure in the liquid line of the system, often rendering the hot gas reheat unit unable to sufficiently warm the air flowing through the device so as to match desired conditions. Therefore, hot gas bypass systems are not commonly used in systems designed to heat a space to greater than 70° F. This is impractical for a large number of desired conditions, which frequently have a temperature set point of 73-75° F. or greater. In one embodiment, the system does not include a hot gas bypass system.

In one embodiment, the system includes a suction pressure monitor 132, which detects the pressure of the suction line 122 leading to the compressor 102. If the suction pressure drops below a preset threshold, then the system is operable to reset the suction pressure by modulating the capacity of the at least one compressor 102, so as to ensure that sufficient amounts of refrigerant are flowing through the evaporator. Resetting the suction pressure ensures that the incoming air is able to be cooled to a dew point temperature of 45° F. In one embodiment, the suction pressure is reset if the suction pressure monitor detects a suction pressure of 105 psi or below.

In one embodiment, the system includes at least one head pressure monitor 130, which detects the pressure in the liquid line 120 for refrigerant exiting the at least one compressor 102. If the head pressure from the at least one compressor 102 drops below a preset threshold, then the system is operable to modulate the discharge rate from the at least one compressor 102.

Figure 2:
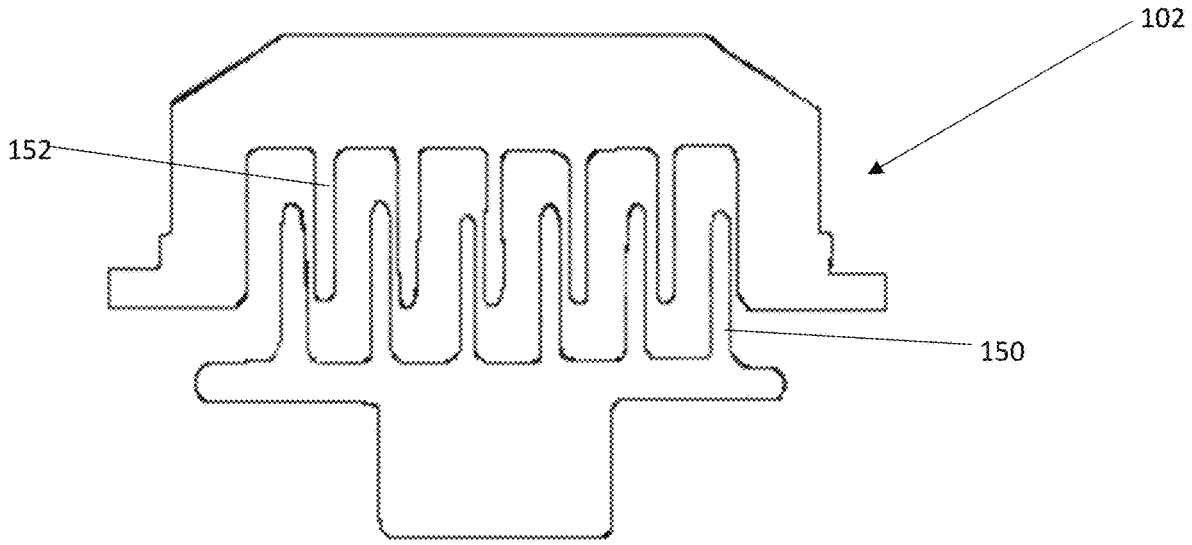
FIG. 2 illustrates an isometric view of a mechanism within a compressor according to one embodiment of the present invention.

As shown in FIG. 2, in one embodiment, the at least one compressor 102 includes a scroll compressor. In a scroll compressor, a first spiral shaped scroll 150 is interleaved with a second spiral shaped scroll 152, where the second spiral shaped scroll 152 is slightly differently shaped compared to the first spiral shaped scroll 150, leaving narrow gaps between the first spiral shaped scroll 150 and the second spiral shaped scroll 152. When the compressor 102 is turned on, the second spiral shaped scroll 152 rotates relative to the first spiral shaped scroll 150, causing fluid coming into the two spiral shaped scrolls to become compressed in the narrow gap between the two spiral shaped scrolls as the fluid moves to the center of the spiral. Because the fluid becomes forced into increasingly small spaces, the fluid increases greatly in pressure, causing the fluid to therefore also increase in temperature before it exits the compressor.

In one embodiment, the at least one compressor 102 is operable to engage in continuous modulation. In continuous modulation, the compressor 102 alternates rapidly between loaded and unloaded states. In the unloaded state, the second spiral shaped scroll 152 is lifted away from the first spiral shaped scroll 150 such that the two spiral shaped scrolls no longer substantially interleave. In the unloaded state, there is no significant mass flow through the compressor 102 as the interaction of the two spiral shaped scrolls is no longer forcing fluid through the device. In the loaded state, the two spiral shaped scrolls are interleaved and mass flow through the compressor 102 approaches 100%. Depending on the requirements of device, including but not limited to the head pressure and the suction pressure of the device, the compressor 102 is able to modulate the amount of time it exists in a loaded state or an unloaded state during a set time period. By way of example, and not of limitation, if the compressor 102 were to require 50% capacity, then during each 20 second time period, the compressor 102 would be in the loaded state for 10 seconds and the unloaded state for 10 seconds. Using continuous modulation, as opposed to simply shutting off the compressor 102 and turning it back on later, allows the hot gas reheat unit 106 to continue operating while keeping suction pressure lower in order to maintain a constant dew point temperature, even during partial load conditions.

In another embodiment, the compressor 102 includes at least one fan 140. When the head pressure drops below the preset threshold, the at least one fan 140 turns off, allowing refrigerant to more quickly move through the compressor 102 and causing condensing temperature to increase. When the at least one head pressure monitor 130 does not detect low head pressure, the at least one fan 140 is turned off. Including at least one compressor fan assists in decoupling the head pressure from the suction pressure. Ordinarily, modulating the compressor capacity so as to address low suction pressure would also mean decreasing head pressure, causing the hot gas reheat unit 106 to be unable to sufficiently warm the outgoing air. However, the use of condenser fans allows the overall capacity of the compressor 102 to be modulated in order to address suction pressure, while allowing the head pressure to be independently increased via use of the fans. Therefore, the systems is capable of addressing issues of low suction pressure while also maintaining sufficient head pressure as to allow the necessary amount of reheat.

In one embodiment, the expansion valve 112 is a thermostatic expansion valve. The thermostatic expansion includes a probe secured to a section of the refrigerant line between the evaporation coil 114 and the compressor 102, such that heat is able to be conducted between the probe and the refrigerant line. When the refrigerant leaving the expansion valve 112 is hotter, separate refrigerant within the probe heats and evaporates, causing compression of a diaphragm of the thermostatic line, thereby increasing the flow of refrigerant to the evaporation coil 114. As the temperature of the refrigerant between the evaporation coil 114 and the compressor 102 falls, the separate refrigerant within the probe condenses and pressure is gradually released on the diaphragm of the thermostatic expansion valve, causing flow of refrigerant to decrease.

In another embodiment, the expansion valve 112 is an electronic expansion valve. The electronic expansion valve is connected to one or more probes, each of which are attached to a section of the refrigerant line. In one embodiment, the one or more probes comprise at least one temperature probe and/or at least one pressure probe. In one embodiment, at least one temperature probe and at least one pressure probe are attached to a section of the refrigerant line between the evaporation coil 114 and the compressor 102. As temperature and/or pressure rise, the probes send an electronic signal to the electronic expansion valve, causing the valve to modulate the rate at which refrigerant is released into the evaporation coil 114 accordingly.

In one embodiment, the expansion valve 112 bleeds approximately 15% of the refrigerant into the evaporation coil 114 at all times. Alternatively, the expansion valve 112 bleeds between approximately 10% and approximately 20% of the refrigerant into the evaporation coil 114 at all times. Allowing refrigerant to bleed into evaporation coil 114 helps to prevent ice buildup on the evaporation coil 114, as there is always a minimum quantity of refrigerant running through the evaporation coil 114, meaning situations of abnormally low suction pressure are avoided entirely.

In one embodiment, the system is operable to modulate the target dew point pressure of the air passing over the evaporation coil 114. When head pressure is insufficiently low so as to provide sufficient refrigerant to the hot gas reheat unit 106 as to heat the outgoing air to a desired temperature even with operation of the compressor fan 140, the compressor 102 is able to increase capacity so as to increase head pressure. However, as the compressor 102 increases capacity, the pressure in the suction line 122 decreases. Therefore, in such a situation the system modulates the set dew point temperature to be lower, as low as 40° F. In one embodiment, each decrease in dew point temperature of 1° F. allows for an increased 3° F. in temperature for air passing over the hot gas reheat unit 106.

In one embodiment, the system is a dedicated outdoor-air system (DOAS). In order to cool larger buildings, DOAS have become more popular in recent years. DOAS have an advantage over traditional variable air volume (VAV) HVAC systems, in that DOAS comprise an outdoor unit designed to handle all of the latent heat capacity of a system in addition to a portion of the sensible heat capacity, while one or more terminal units within a building handle the remaining sensible heat capacity. By splitting the load of the HVAC in this way, outdoor air that is ventilated into a building is better able to be dehumidified and cooled so as to make the building more comfortable.

In one embodiment, the system includes an Energy Recovery Ventilator (ERV) 116 in order to precondition outside air. The ERV 116 takes in outside air and exhaust air from the system and outputs some air into the surrounding environment, while also providing outside air to the system. In warm and humid conditions, heat and water is transferred from the outside air to the exhaust airstream of the ERV 116. The ERV 116 therefore cools and dehumidifies the outside air before the air is treated by the system, reducing the necessary work, and therefore the amount of energy consumed, by the system. In cool and dry conditions, heat is transferred to the outside air by the exhaust air stream from the system, allowing the outside air to be heated before being acted upon by the system, therefore reducing the necessary work, and reducing the amount of energy consumed.

In one embodiment, the ERV 116 is a rotary heat exchanger. The rotary heat exchanger includes a rotating wheel with a plurality of holes extending through the thickness of the wheel. Surrounding the wheel are two separate passages, one which allows exhaust air through a plurality of holes of half of the rotating wheel, and another which allows supply air through a plurality of holes of the other half of the rotating wheel. In one embodiment, the rotary heat exchanger includes desiccants within or surrounding at least one of the plurality of holes. When relatively hot exhaust air passes through the plurality of holes of half of the rotating wheel, heat is transferred from the exhaust air to the supply air, while the desiccants remove moisture from the supply air. On the other hand, when relatively hot supply air passes through the plurality of holes of the other half of the rotating wheel, heat transfers from the supply air to the exhaust air, cooling the incoming air stream, while still dehumidifying it through the desiccants. In one embodiment, the ERV includes at least one fan to blow the exhaust air through the rotating wheel. In another embodiment, the ERV includes at least one fan to blow the supply air through the rotating wheel. In one embodiment, the at least one fan blowing the exhaust air operates at approximately the same speed as the at least one fan blowing the supply air. In another embodiment, the at least one fan blowing the exhaust air operates at a different speed than the at least one fan blowing the supply air.

In another embodiment, the ERV 116 is a fixed plate exchanger. The fixed plate exchanger includes at least four fluid ports, including a top left fluid port, a bottom left fluid port, a top right fluid port, and a bottom right fluid port, all of which allow air into or out of a housing. Between the fluid ports is an exchange device. The exchange device is angled relative to the housing and has openings allow to flow into the top left, top right, bottom left, and bottom right of the exchange device. Supply air enters through the top left fluid port, passes through the opening in the top left of the exchange device, exits through the bottom right of the exchange device and finally exits out of the bottom right fluid port. Exhaust air enters through the top right fluid port, passes through the opening in the top right of the exchange device, exits through the bottom left of the exchange device and finally exits out of the bottom left fluid port. While both the supply air stream and the exhaust air stream pass through the exchange device in opposing but intersecting directions, the supply air stream and exhaust air stream do not mix. Instead, the paths for the supply air and the exhaust air are completely separated within the fixed plate exchanger. However, the exchange device includes at least one heat exchange plate, which absorbs heat from the hotter airstream and release it into the colder airstream. In one embodiment, at least one desiccant is including within the exchange device, causing moisture to be transferred from the more humid airstream to the less humid airstream.

Current standards promulgated by the American Society of Heating, Refrigerating and Air-Conditioning (ASHRAE), such as Standard 62.1-2019, require a minimum amount of outside air to be ventilated into each room of a building, based on the size of the room and the number of people within the room. For example, each additional individual within a room requires between 5 and 20 additional cubic feet per minute (cfm) of outside air to be ventilated in, depending on the type of location involved, while each additional square foot of area for the room requires between 0.06 and 0.18 additional cfm of outside air to be ventilated in. An equation for the amount of outside air required to be ventilated into a room is shown in Equation 1 below, wherein $V_{bz}$ is the breathing zone outdoor airflow, $R_p$ is the outdoor airflow rate per person as dictated by ASHRAE, $P_z$ is the population of the room, $R_a$ is the outdoor airflow rate per unit area as dictated by ASHRAE, and $A_z$ is the area of the room.

$$V_{bz}=R_p*P_z+R_a*A_z \quad \text{(Equation 1)}$$

In order to ensure that the air that is supplied to a given room achieves a desired level of humidity and temperature, some DOAS cool and thereby dehumidify the outside air to a specific dew point before delivering it to the necessary space. Due to industry standards, existing DOAS do not usually set the dew point temperature lower than 55° F. However, using a dew point temperature of 55° F. causes problems in achieving the desired relative humidity levels within the space.

In one embodiment, the system is operable to meet the requirements of ASHRAE Standard 90.1-2019, Section. 6.5.2.3. According to standard 90.1-2019, when humidistatic controls are provided, "such controls shall prevent reheating, mixing of hot and cold airstreams, or other means of simultaneous heating and cooling of the same airstream" unless "at least 75% of the energy for reheating or for providing warm air in mixing systems is provided from a site-recovered (including condenser heat) or sitesolar energy source." Therefore, in one embodiment of the present invention, the system is operable to meet the requirements of 90.1-2019, Section 6.5.2.3, as the heat from the compressor supplies at least 75% of the energy needed for the hot gas reheat unit.

In one embodiment, the system employs demand-controlled ventilation, automatically adjusting the airflow rate and the amount of outdoor airflow depending on the number of individuals present in a given area. In one embodiment, the system includes at least one $CO_2$ sensor, which is operable to detect the number of people in a space. In another embodiment, the system includes at least one scheduler, wherein the scheduler includes an estimated occupancy of the space at various points during a day, during a week, during a month, and/or during a year, such that the system is able to automatically adjust the airflow rate and/or the amount of outdoor airflow depending on the estimated occupancy for a given time in the scheduler. In yet another embodiment, the system includes at least one motion sensor, such as an infrared sensor, which is operable to determine the amount of motion in a space in order to determine an estimated occupancy. In still another embodiment, the system is connected with at least one security camera system, wherein the security camera system is able to automatically determine an occupancy for the space based on visual analysis of a camera feed.

FIG. 3 is a chart detailing the performance of an HVAC system at various load conditions according to one embodiment of the present invention. As shown in FIG. 3, the system is capable of both cooling air of a wide range of outside air temperatures to a dew point temperature of approximately 45° F. and subsequently reheating the air to a temperature of approximately 75° F. while maintaining a constant airflow rate of 5000 cfm. Even where outside air temperatures are below 55° F., the system is capable of net warming the air, after having dehumidified it. One of ordinary skill in the art will understand that, as used in the chart, CFM stands for cubic feet per minute, Amb. stands for ambient, DB stands for Dry Bulb Temperature, OA stands for Outside Air, WB stands for Wet Bulb Temperature, ERV stands for Energy Recovery Ventilator, Cap. stands for Capacity, Sens. stands for Sensible Heat, Evap. stands for Evaporator, DP stands for Dew Point Temperature, MRC stands for Moisture Removal Capacity, MRE stands for Moisture Removal Efficiency, HGRH stands for Hot Gas-Reheat, LAT stands for Leaving Air Temperature, and Supp. stands for Supplemental. With regard to FIGS. 4-8, one of ordinary skill will understand that CA stands for Cooled Air, RA stands for Recirculated Air, SA stands for Supply Air, and RH stands for Relative Humidity.

Controlling the dew point temperature and output temperature in both warming and cooling situations represents a significant improvement over prior art, as typical air conditioners are generally unable to dehumidify air while in warming mode. Existing air conditioners often dehumidify air by taking in warm air, cooling it and pumping out the cooled air or air that is slightly reheated, but still below the outside air temperature. When existing air conditioners take in cool air, the cool air passes over the condenser and warms, without significant dehumidification as occurs at the evaporation coil in the present invention. Even for existing air conditioners that maintain a set dew point temperature, the dew point temperature is set at 55° F. or higher, meaning that if outside air is taken in at, for example, 60° F., then little to no dehumidification occurs before that air is supplied to a space.

Example 1

In one example, for an office conference room with an area of 1000 $ft^2$ and a design occupancy of 25 people, the airflow rate of the outside air is required to be at least 185 cfm according to Equation 1. Additionally, the design latent load can be calculated to be approximately equal to 3,900 Btu/hr, given ASHRAE standards of 155 Btu/hr/person for office environments. The amount of sensible load can be calculated using a load calculation software, which in the case shows a sensible load of 11,800 Btu/hr for the space. Because the sensible heat ratio (SHR) is equal to the amount of sensible load over the total load for the system, the SHR is calculated to be 0.75. In this case, it is assumed that the desired dry bulb temperature for the space is 75° F., while the desired relative humidity is 50%, with the desired humidity ratio therefore being approximately 65.3 gr/lb. In this case, the outdoor dry bulb temperature is equal to 92° F., while the outdoor relative humidity is approximately 45%, meaning the humidity ratio outside approximately 102 gr/lb. Because the outdoor unit is cooling the outdoor air to a dew point temperature of 55° F. (and a humidity ratio of approximately 63.7 gr/lb), the sensible load offset by the outdoor unit can be calculated to be equal to approximately 4,015 btu/hr by Equation 2 below, assuming the air is not reheated before being delivered. Additionally, the latent load offset by the outdoor unit can be calculated via Equation 3 to be approximately 204 btu/hr.

$$Q_{sensible}=1.085*V_{bz}*(T_{space}-T_{delivered}) \quad \text{(Equation 2)}$$

$$Q_{latent}=0.69*V_{bz}*(W_{space}-W_{delivered}) \quad \text{(Equation 3)}$$

Figure 4:
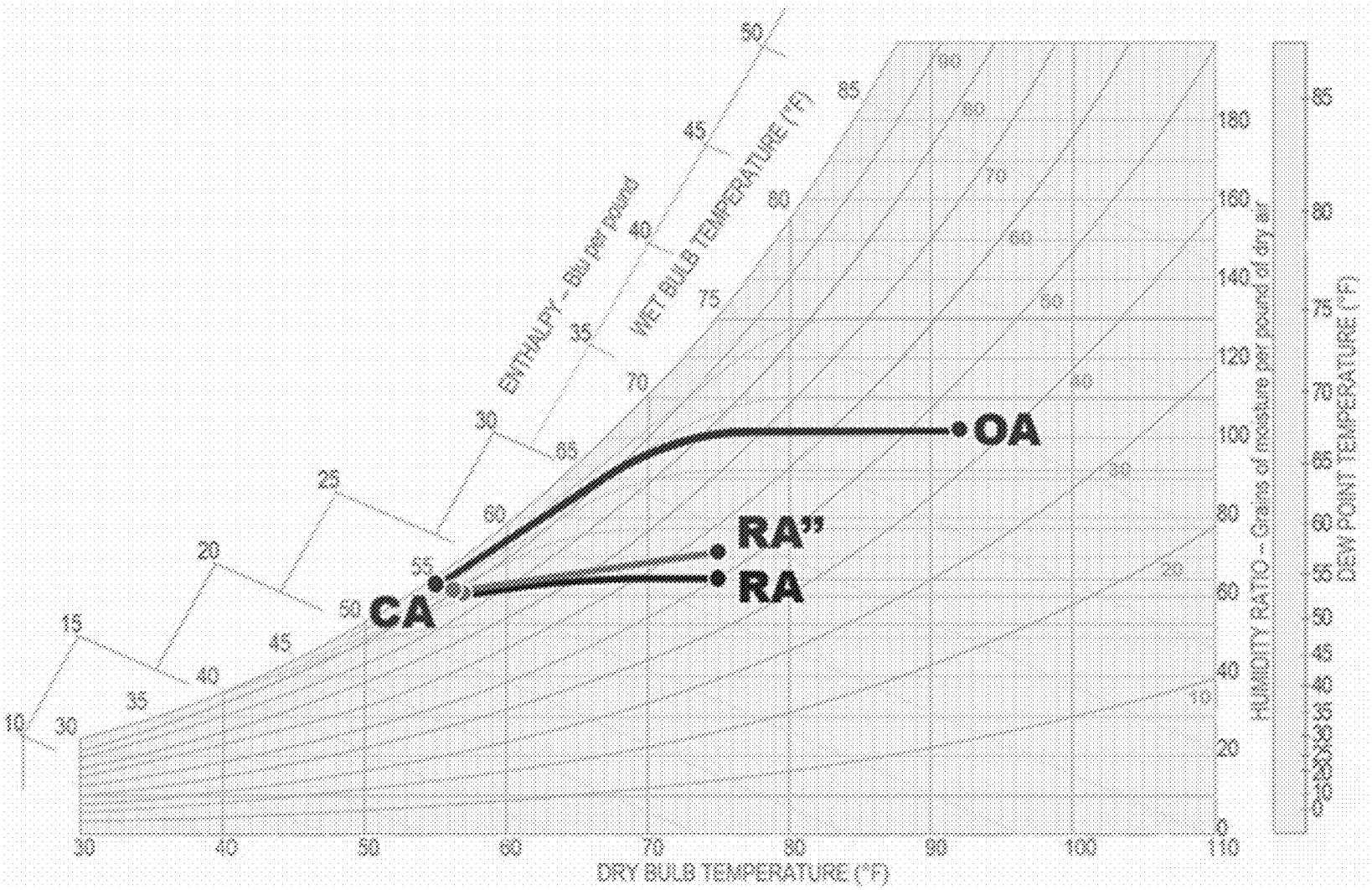
FIG. 4 illustrates a psychrometric chart, demonstrating the use of a 55° F. dew point temperature by an existing system.

Now, because the DOAS offsets 4,015 btu/hr of sensible load, the amount of sensible load required to be offset by the terminal unit is 7785 btu/hr. Assuming that the terminal unit delivers cooled recirculated air at approximately 57.2° F. and a humidity ratio of 60.1 (corresponding to a wet bulb temperature of 55° F.), the airflow from the terminal unit can be calculated to be approximately 400 cfm. Plugging this value back into Equation 3, the latent load offset by the terminal unit is calculated to be approximately 1435 btu/hr. A psychrometric chart, such as that illustrated in FIG. 4, is used to find the final room temperature and humidity. By finding the point representing the combined temperature and humidity of the air coming from the outdoor unit and the terminal unit, a line from that point with a slope calculated using the SHR value of 0.75 and a psychrometric compass is drawn. The point at which the drawn line intercepts a vertical line corresponding to a dry bulb temperature of approximately 75° F. provides a final relative humidity of about 55%, 5% higher than the desired humidity value. This result follows from the fact that the outdoor unit and the terminal unit only offset a combined 1639 btu/hr of a total of 3,900 btu/hr of latent load.

Example 2

Using identical input variables as those in Example 1, it is shown that a set dew point temperature of 45° F. for the outdoor unit better approximates the desired humidity value for a space. The change in temperature allows the outdoor unit to offset 6,022 btu/hr of sensible load and 2,740 btu/hr of latent load. Furthermore, this allows the terminal unit to only deliver 296 cfm of air at 57.2° F. and a humidity ratio of 60.1, which offsets another 1,062 btu/hr of latent load, for a combined offset latent load of 3802 btu/hr out of the total 3,900 btu/hr.

Figure 5:
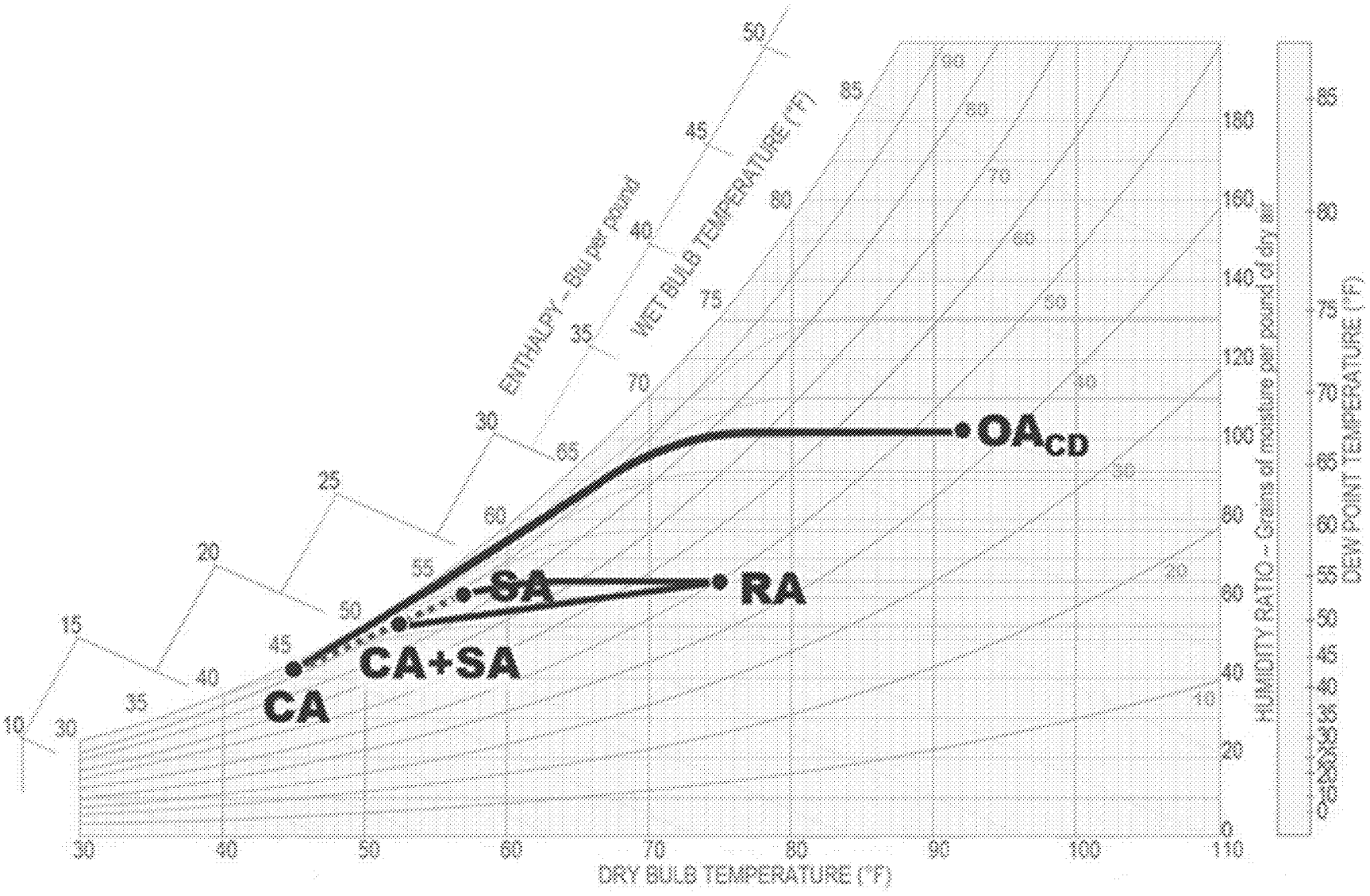
FIG. 5 illustrates a psychrometric chart, demonstrating the use of a 45° F. dew point temperature according to one embodiment of the present invention.

The difference in offset latent load is highlighted by the relatively less humid room temperature achieved, as shown in the psychrometric chart presented in FIG. X. As is seen in FIG. 5, the temperature and humidity achieved from the combination of the air from the outdoor unit and the recirculated supply air is at a lower temperature that the corresponding point from Example 1. As such, when one draws the SHR line from the combined point to find the final room temperature and humidity, it can be seen that the final relative humidity for the room is approximately 50%, rather than 55%, better approximating the desired humidity conditions. Furthermore, because the 45° F. dew point temperature system offsets a greater amount of load than the 55° F. example does, the terminal unit is also able to be sized to be smaller, with a smaller amount of airflow being necessary from the terminal unit in order to offset the remaining sensible load.

Example 3

Figure 6:
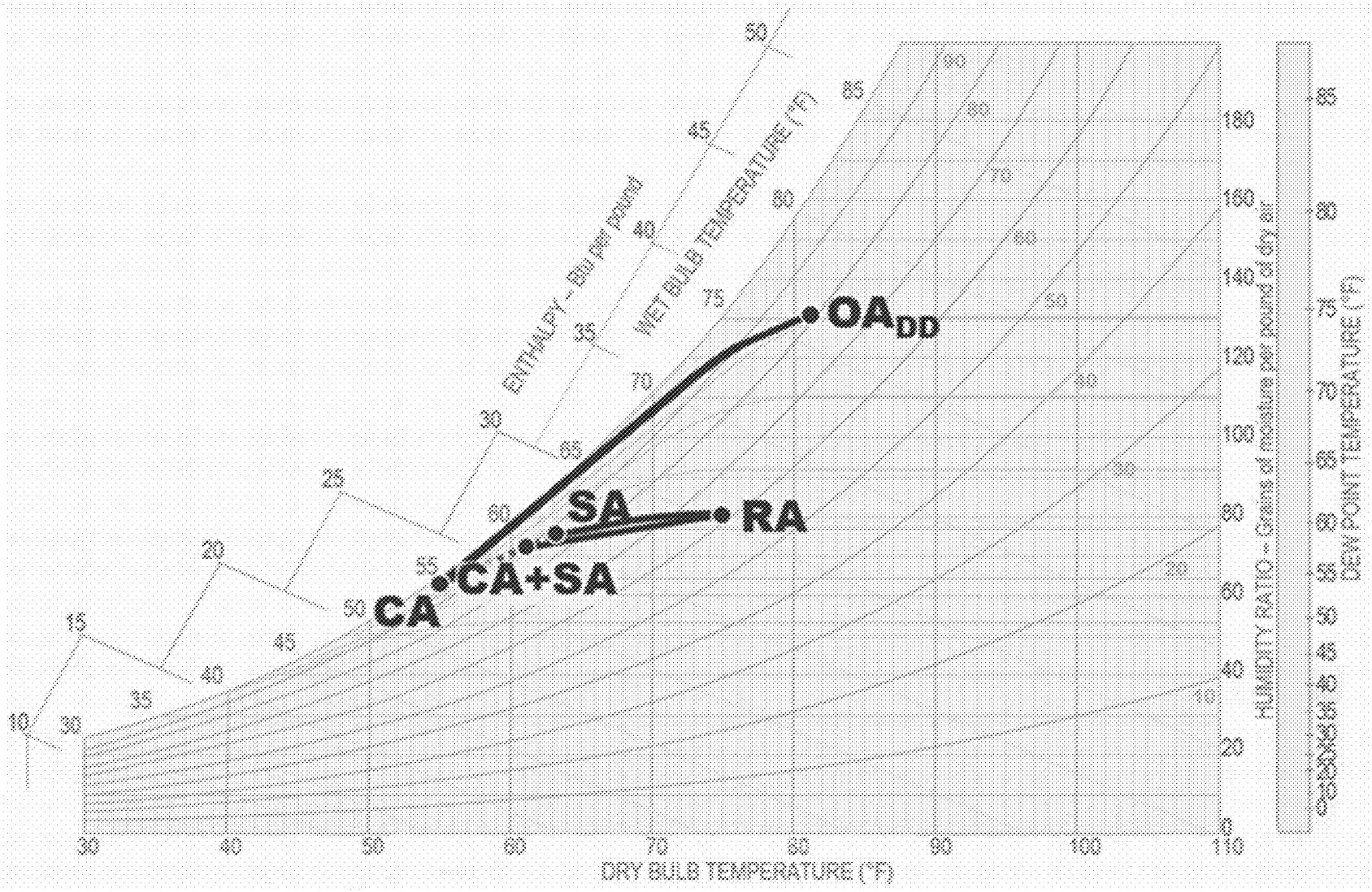
FIG. 6 illustrates a psychrometric chart, demonstrating the use of a 55° F. dew point temperature at a part-load condition by an existing system.

The difference in performance between a 55° F. dew point temperature and a 45° F. dew point temperature is even more striking when looking at part load conditions. Some HVAC systems are designed to detect where there is less load than the amount accounted for under design conditions and therefore correspondingly decrease their airflow in order to save power under these conditions. For example, rather than the total sensible load being 11,800 btu/hr, it would instead be only about 75% of the design conditions, or about 8,850 btu/hr. In order to meet ASHRAE ventilation conditions, the outdoor unit operating with a dew point temperature of 55° F. would still operate at 185 cfm and therefore still offset 4,015 btu/hr of the 8,850 btu/hr. Because terminal units are still often programmed to circulate a set percentage of their peak load condition airflow at part loads, the terminal unit would still circulate, for example, 75% of its peak load airflow, or 300 cfm. The terminal unit therefore outputs less air and at a higher temperature, resulting in the system delivering air at 75° F., but at a much higher relative humidity, close to 62%, as shown in FIG. 6.

Figure 7:
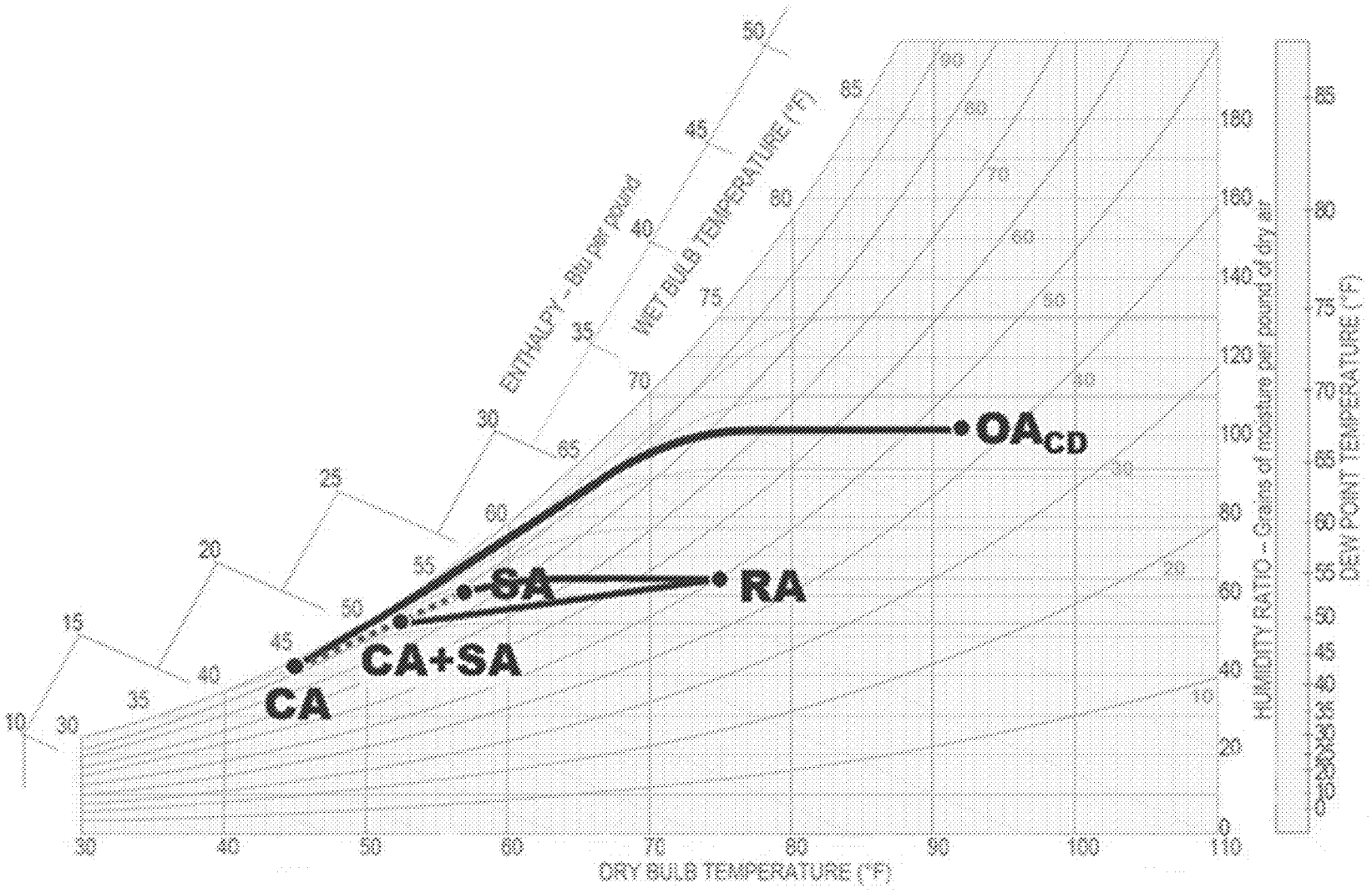
FIG. 7 illustrates a psychrometric chart, demonstrating the use of a 45° F. dew point temperature at a part-load condition according to one embodiment of the present invention.

With a part load condition of 75% and a set dew point temperature of 45° F., the outdoor unit would offset 6,022 btu/hr of the 8,850 btu/hr of sensible load, leaving only 2,828 btu/hr to be offset by the terminal unit. Again, with 75% of the airflow coming from the terminal unit, or about 222 cfm in this case, the resulting room conditions are calculated to be approximately 75° F. with a humidity of about 55%, achieving results closer to desired conditions than the 55° F. example, as shown in FIG. 7.

Figure 8:
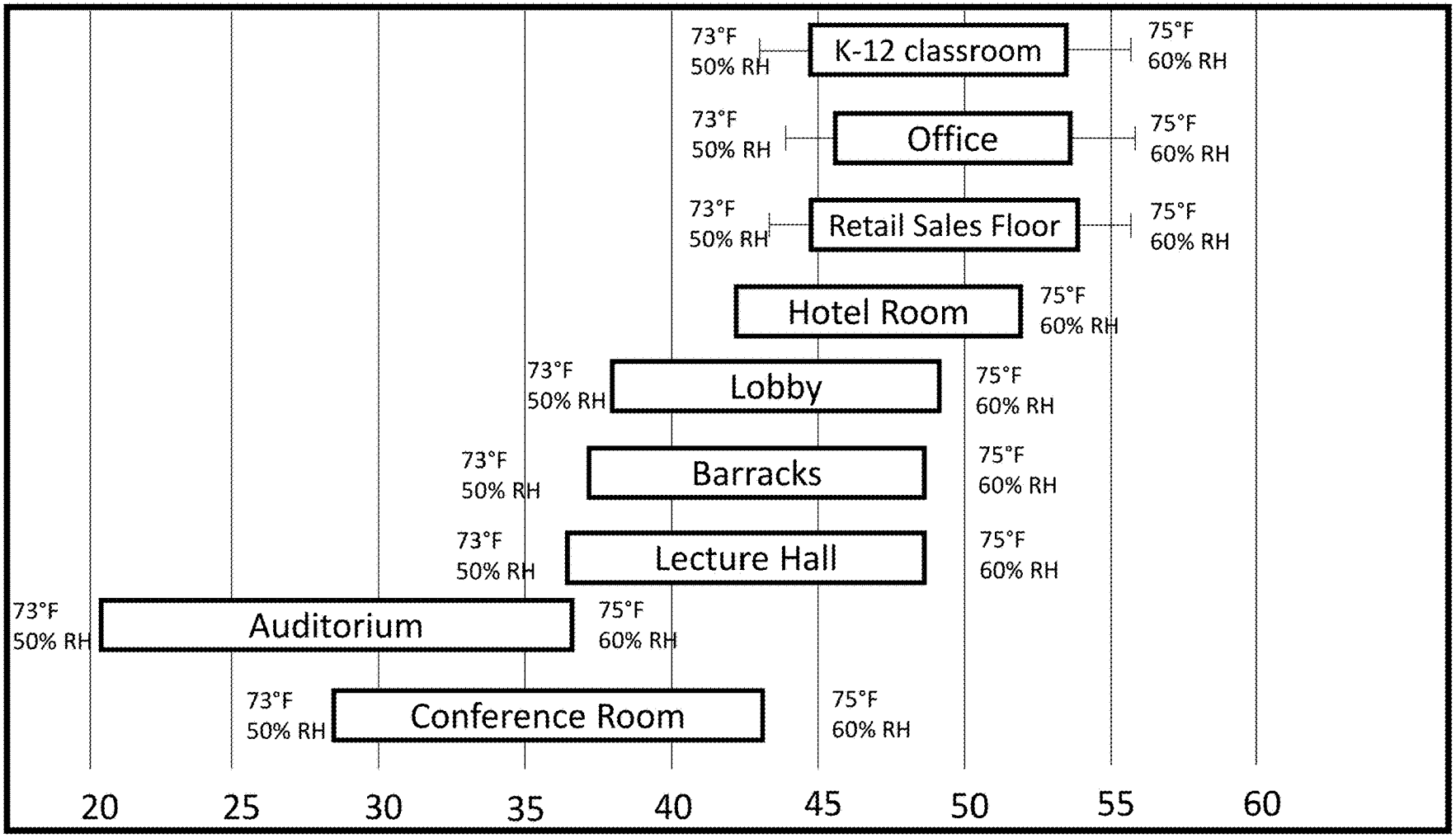
FIG. 8 is a chart showing a range of dew point temperatures capable of sufficiently ventilating a number of types of spaces at a range of desired conditions.

As shown in FIG. 8, a 45° F. dew point temperature is able to accommodate a wider variety of spaces at normal set conditions than a 55° F. dew point temperature. A 55° F. dew point temperature is unable to properly service most environments at typical capacity, with the possible exception of K-12 classrooms, offices, or retail sales floors when those environments have a higher set temperature and relative humidity. A 45° F., however, is able to accommodate a far larger range of environments, including lobbies, barracks, lecture halls, and hotel rooms in addition to K-12 classrooms, offices, and retail sales floors, and is able to accommodate those spaces at lower set temperatures and relative humidities. Furthermore, for large spaces with high occupancy, such as conference rooms and auditoriums, the 45° F. is far closer to the ideal set dew point temperature than 55° F.

The above-mentioned examples are provided to serve the purpose of clarifying the aspects of the invention, and it will be apparent to one skilled in the art that they do not serve to limit the scope of the invention. By nature, this invention is highly adjustable, customizable and adaptable. The above-mentioned examples are just some of the many configurations that the mentioned components can take on. All modifications and improvements have been deleted herein for the sake of conciseness and readability but are properly within the scope of the present invention.

The invention claimed is:

1. A climate-control system, comprising:

a refrigeration circuit including at least one compressor, a condenser, an expansion valve, an evaporator coil, and a hot gas reheat coil; and at least one first detector monitoring a head pressure of refrigerant exiting the at least one compressor and at least one second detector monitoring a suction pressure of refrigerant entering the at least one compressor;

wherein the hot gas reheat coil is positioned between the at least one compressor and the condenser in the refrigeration circuit;

wherein the climate-control system to delivers air to a space at a dew point temperature of 45° F. or lower;

wherein a capacity of the at least one compressor is modified through continuous modulation based on data produced by the at least one first detector monitoring the head pressure of refrigerant exiting the at least one compressor and the at least one second detector monitoring the suction pressure of refrigerant entering the at least one compressor;

wherein the climate-control system is configured to reset the suction pressure of refrigerant entering the at least one compressor by automatically decreasing the capacity of the at least one compressor if the at least one second detector detects the suction pressure of refrigerant entering the at least one compressor is less than 105 psi;

wherein the expansion valve is configured to bleed 15% of the refrigerant entering the evaporator coil; and wherein the at least one compressor includes at least one fan, wherein the at least one fan is configured to turn off when the at least one first detector detects the head pressure of refrigerant is below a preset threshold pressure.

2. The climate-control system of claim 1, further comprising an energy recovery ventilator, wherein the energy recovery ventilator is configured to pretreat air coming into the climate-control system.

3. The climate-control system of claim 1, wherein the climate-control system delivers air to the space at a dry bulb temperature between 45° F. and 75° F.

4. The climate-control system of claim 1, wherein the climate-control system is part of a Dedicated Outdoor Air System (DOAS).

5. The climate-control system of claim 1, wherein the climate-control system delivers air to the space at a dew point temperature of 40° F. or lower.

6. The climate-control system of claim 1, further comprising at least one motion sensor operable to determine an estimated occupancy of the space.

7. The climate-control system of claim 1, further comprising a scheduler, wherein the scheduler generates and/or receives an estimated occupancy of the space at various times during a year and automatically adjusts an airflow rate and/or an amount of outdoor airflow for the climate-control system based on the estimated occupancy.

8. The climate-control system of claim 2, wherein the energy recovery ventilator is a rotary heat exchanger.

9. A method of delivering air to a space, comprising:

providing a unit, including a refrigeration circuit including at least one compressor, a condenser, an expansion valve, an evaporator coil, and a hot gas reheat coil;

wherein the hot gas reheat coil is positioned between the at least one compressor and the condenser in the refrigeration circuit; and wherein the unit includes at least one first detector monitoring a head pressure of refrigerant exiting the at least one compressor and at least one second detector monitoring a suction pressure of refrigerant entering the at least one compressor;

engaging in continuous modulation to modify a capacity of the at least one compressor based on data produced by the at least one first detector monitoring the head pressure of refrigerant exiting the at least one compressor and the at least one second detector monitoring the suction pressure of refrigerant entering the at least one compressor;

at least one fan of the at least one compressor turning off when the at least one first detector detects the head pressure of refrigerant is below a preset threshold pressure;

the expansion valve bleeding 15% of the refrigerant entering the evaporator coil; and the unit delivering air to the space at a 45° F. or lower dew point temperature.

10. The method of claim 9, further comprising an energy recovery ventilator pretreating air coming into the unit.

11. The method of claim 9, further comprising the unit delivering air to the space at a dry bulb temperature between 45° F. and 75° F.

12. The method of claim 9, wherein the unit is part of a dedicated outdoor air system (DOAS).

13. The method of claim 9, further comprising the unit delivering air to the space at a 40° F. or lower dew point temperature.

14. A climate-control system, comprising:

a refrigeration circuit including at least one compressor, a condenser, an expansion valve, an evaporator coil, and a hot gas reheat coil;

wherein the hot gas reheat coil is positioned between the at least one compressor and the condenser in the refrigeration circuit; and at least one first detector configured to monitor a head pressure of refrigerant exiting the at least one compressor and/or at least one second detector configured to monitor a suction pressure of refrigerant entering the at least one compressor;

wherein the at least one compressor is operable to engage in continuous modulation based on data produced by the at least one first detector monitoring the head pressure of refrigerant exiting the at least one compressor and/or the at least one second detector monitoring the suction pressure of refrigerant entering the at least one compressor;

wherein the continuous modulation by the at least one compressor is performed by the at least one compressor alternating between loaded and unloaded states, wherein, in a loaded state, scrolls of the at least one compressor are interleaved, and wherein, in an unloaded state, the scrolls of the at least one compressor are not interleaved;

wherein the expansion valve is configured to bleed 15% of the refrigerant going into the evaporator coil; and wherein the at least one compressor includes at least one fan, wherein the at least one fan is configured to turn off when the at least one first detector detects the head pressure of refrigerant is below a preset threshold pressure.

15. The climate-control system of claim 14, further comprising an energy recovery ventilator, wherein the energy recovery ventilator is configured to pretreat air coming into the climate-control system.

16. The climate-control system of claim 14, wherein the climate-control system is part of a Dedicated Outdoor Air System (DOAS).

17. The method of claim 9, further comprising resetting the suction pressure of refrigerant entering the at least one compressor by automatically decreasing the capacity of the at least one compressor if the at least one second detector detects the suction pressure of refrigerant entering the at least one compressor is less than 105 psi.

18. The climate-control system of claim 14, wherein the climate-control system does not include a hot gas bypass system.

19. The climate-control system of claim 15, wherein the energy recovery ventilator is a rotary heat exchanger.

* * * * *